US005975034A

United States Patent [19]

Han

[11] Patent Number: 5,975,034

[45] Date of Patent: Nov. 2, 1999

[54] FREE PISTON INTERNAL COMBUSTION ENGINE AND STARTING METHODS

[76] Inventor: William Han, 9, Alley 1, Lane 8, Hong-Tao St. Hsi-Chih Town, Taipei, Taiwan

[21] Appl. No.: 09/087,773

[22] Filed: Jun. 1, 1998

Related U.S. Application Data

[63] Continuation-in-part of application No. 08/679,226, Jul. 12, 1996, Pat. No. 5,678,522.

[51] Int. Cl.[6] ..... F02B 71/00

[52] U.S. Cl. ..... 123/46 SC

[58] Field of Search ..... 123/46 R, 46 SC

[56] References Cited

U.S. PATENT DOCUMENTS 4,308,720 1/1982 Brandstadter ..... 123/46 R

*Primary Examiner*—Noah P. Kamen

*Attorney, Agent, or Firm*—Rosenberg, Klein & Lee

[57] ABSTRACT

A free piston internal combustion engine is under the control of micro-computer, and according to the two stroke cycle principle operating. Piston retracts by a spring. A hydraulic system outputs the power. Starting method is, when the piston is held at the end of the compression stroke, some fuel and compressed air inject into combustion chamber, perform a well-mixed compressed mixture, and then ignite for a explosion so that the engine begins the normal operating cycles.

2 Claims, 3 Drawing Sheets

FREE PISTON INTERNAL COMBUSTION ENGINE AND STARTING METHODS

CROSS-REFERENCE

This is a continuation-in-part application of U.S. Ser. No. 08/679,226 filed Jul. 12, 1996, U.S. Pat. No. 5,678,522, owned by the same inventor.

BACKGROUND OF THE INVENTION

1. Field of the Invention

This invention is related to a free piston internal combustion engine and starting methods.

2. Description of the Prior Art

Free piston internal combustion engines are simple in construction and can directly convert chemical energy into various kinds of power. However, it is very difficult to start such engines thereby making it unable to be widely utilized.

As the super charge effect of two-stroke engines is not eminent, it is proposed to adopt the well-known loop scavenging method and exhaust pipe tuning method to increase the efficiency. Tuning method is suitable for free piston engines, because its operating velocity is limited to smaller range thereby making it easier to accomplish the highest efficiency.

The previous hydraulic power output system utilizes adjustable pressure output system to adapt to different output pressure demands, which is a variable pressure output system. At present, it is replaced with full power stroke output, i.e. constant pressure output system. As the actual stroke of the engine according to the present invention is not all the same, there will be automatic compensation function in a certain range of the power output. That is to say, if the load is decreased, the stroke will become longer, but vice versa. This feature is helpful for operation and control.

SUMMARY OF THE INVENTION

This invention is related to a free piston internal combustion engine and starting methods.

The free piston internal combustion engine according to the present invention is compact in structure and the reciprocating mass is small, so that the running velocity and the ratio of horse power to weight can be increased for supplying hydraulic power to ordinary vehicles, constructions, mining industry, heavy duty mechanical apparatuses, and the like.

As the length of the present invention is decreased, it is possible to assemble two power devices with common axial synchronous motion within reasonable range so as to reduce the reciprocating force thereby lowering the vibration in operation to the lowest possible. As a consequence, the operator of the present invention will feel more comfortable as compared with the conventional diesel engine.

In addition, the present invention utilizes a computer to control air-fuel ratio to decrease the fuel consumption rate. By means of this unique starting method, there is no need for the engine to run continuously. Instead, as the engine is of low inertia characteristic, the engine will run when in use, but will stop when not in use. The engine can be started easily and definitely and consumes less power.

Furthermore, the pollution produced by the combustion of the engine according to the present invention is lowered thereby reducing air pollution. The engine according to the present invention utilizes pure air scavenging method, i.e. injecting fuel into the cylinder only after the exhaust port is closed thus preventing fuel from entering into the exhaust pipe. There is accurate amount of fuel injection from the beginning of the operating cycle and no extra fuel consumption in cool starting. The above-mentioned three features are totally different from the conventional two-stroke engine.

As the structure of the engine according to the present invention is very simple and does not include expensive components, high-tech material, or extreme production technique, the production of the engine will be very easy and low in cost.

DETAILED DESCRIPTION OF THE PREFERRED EMBODIMENT

Figure 1:
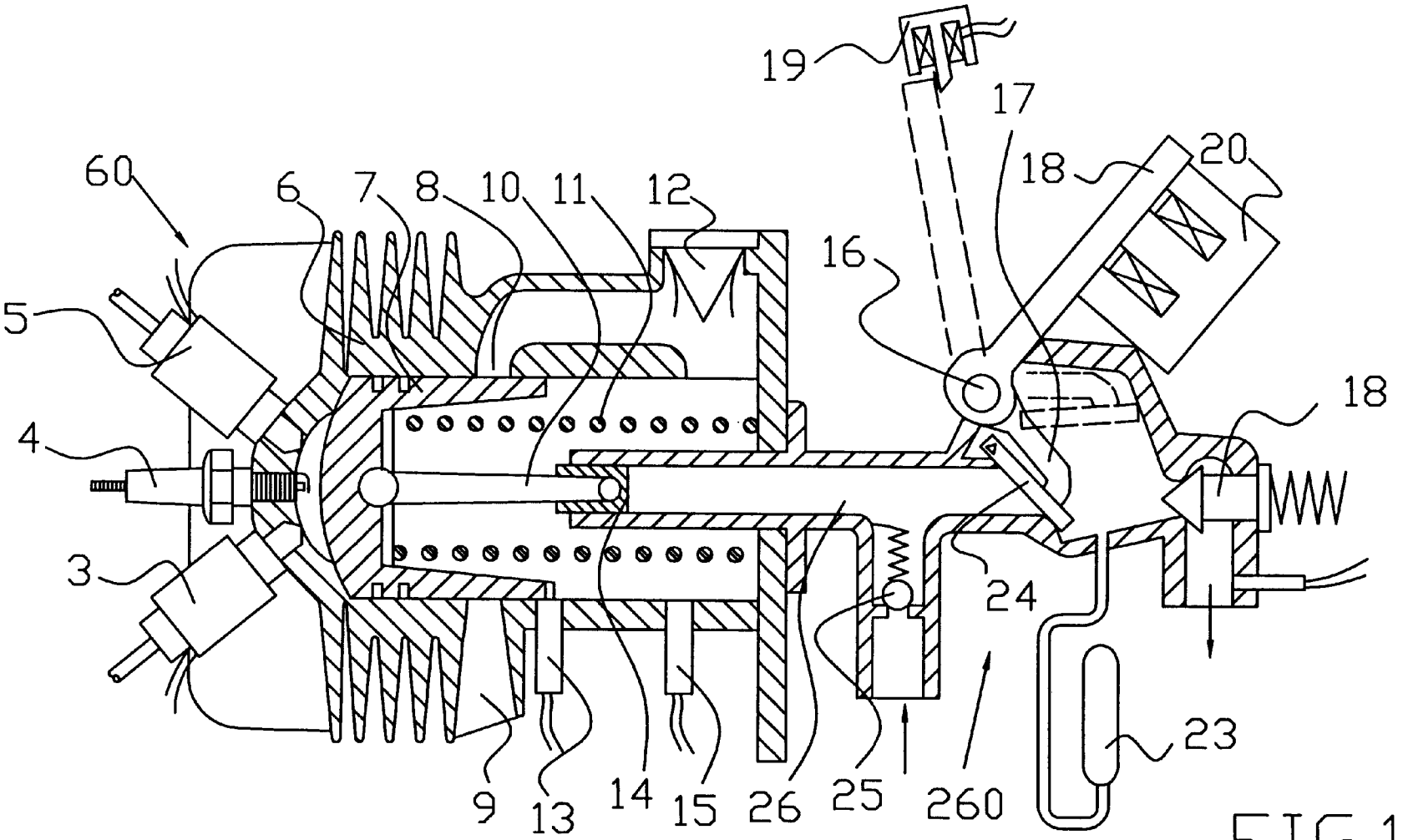
FIG. 1 is a sectional view of a free piston internal combustion engine according to the present invention.

With reference to the drawings and in particular to FIG. 1 thereof, the free piston internal combustion engine according to the present invention generally comprises a cylinder assembly 600, a power piston 7, a hydraulic cylinder assembly 260, and an electronic control unit.

The cylinder assembly 600, in which is fitted the power piston 7, is provided with a fuel injection valve 3 and a compressed air injection valve 5 so that fuel and compressed air can be directly injected into a combustion chamber formed between the cylinder assembly 600 and the front end of the power piston 7 and ignited by a spark plug 4. A scavenging chamber is formed at the rear space. Air can flow through the inlet reed valve 12 to the scavenging chamber and flow out of the scavenging chamber through the scavenging port 8. The rear end of the cylinder assembly 600 is connected to the hydraulic cylinder assembly 260 for power output.

The interior of the power piston 7 is connected with a main spring 11 and a ball-end pushrod 10. The main spring 11 is used for absorbing kinetic energy in power stroke for pushing back the power piston 7 in compression stroke. The other end of the ball-end pushrod 10 is connected to a hydraulic piston 14 and provided at the rear end with an interrupter for sensing an ignition sensor 13 and a fuel injection sensor 15.

The hydraulic cylinder assembly 260 includes a hydraulic cylinder 26, a hydraulic piston 14, an inlet valve 25, an outlet valve 24, an accumulator 23, an output pressure control valve 21, a hydraulic pressure sensor 22, and a start holding device. The start holding device includes a shaft 16, a short arm 17, a long arm 18, a magnet 20, and an electromagnetic actuator 19, which is designed for holding the piston when the engine is starting. The accumulator 23 is used for absorbing hydraulic pulses. The pressure control valve 21 is used for maintaining the output pressure.

Figure 2:
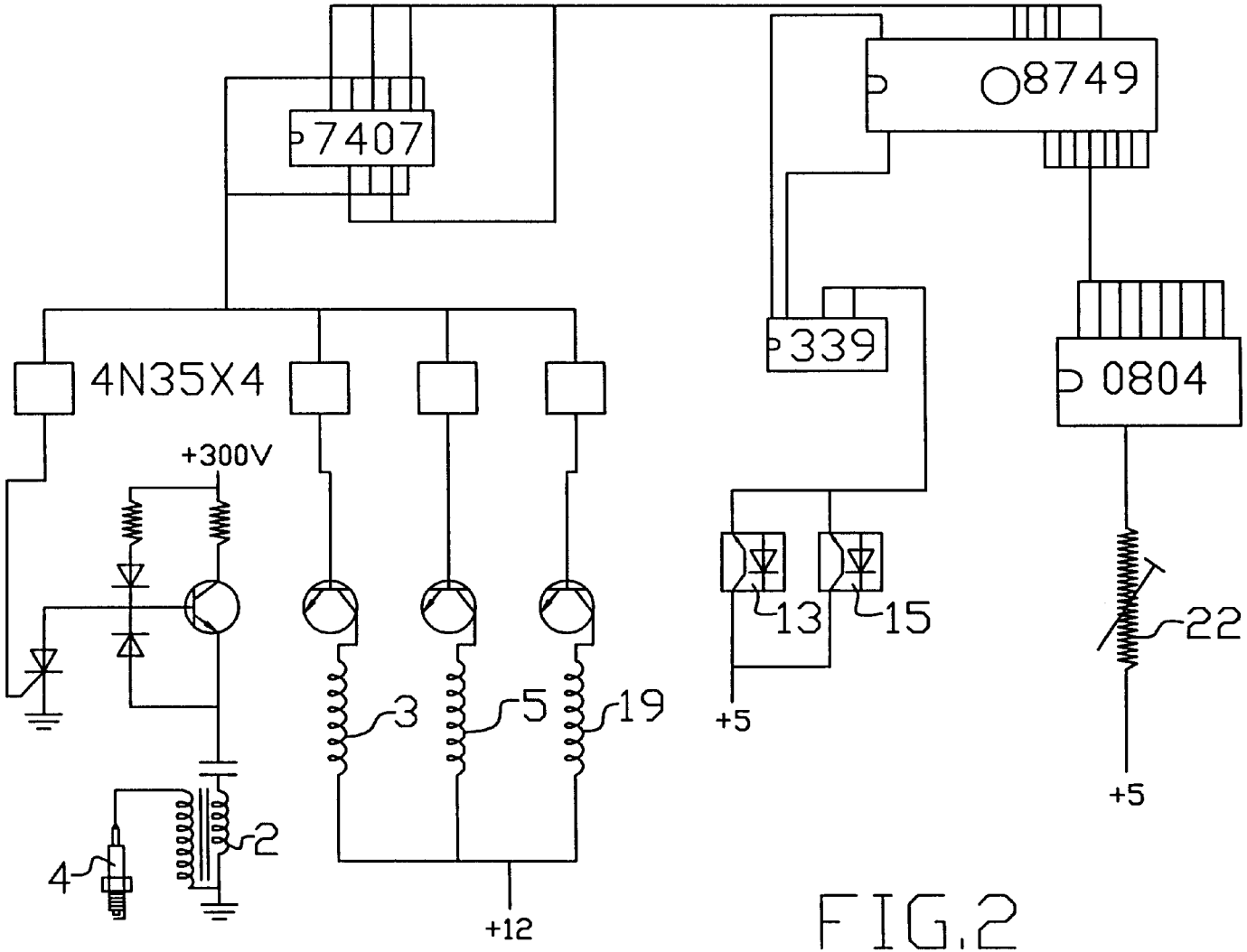
FIG. 2 is a circuit diagram of an electronic control unit according to the present invention.

The electronic control unit (see FIG. 2) includes a single chip microprocessor 8749 and other interface circuits for receiving signals from the ignition sensor 13, the fuel injection sensor 15, and the hydraulic pressure sensor 22 of the analog-to-digital converter 0804. There is a computer program for operating the fuel injection valve 3, the compressed air injection valve 5, the magnetic actuator 19, and the condenser discharging ignition circuit to ignite the spark plug 4 via the ignition coil 2.

As the engine is starting, the single chip micro-processor will first actuate the electromagnetic actuator 19 of the start holding device thereby releasing the long arm 18 to be attracted by the magnet 20. The attracting force is applied by the shaft 16 and the short arm 17 to the outlet valve 24. In the meantime, the hydraulic cylinder 26 is in locked condition and the power piston 7 is held by the hydraulic fluid.

The central processing unit causes the fuel injection valve 3 to inject a fixed amount of gaseous fuel, actuates the compressed air injection valve 5 to inject compressed air to wait for performing to provide even well-mixed compressed air-fuel mixture, and then ignites by the spark plug 4. Meanwhile, the piston holding force is equal to or slightly larger than the compression force, so that the piston 7 will be kept stationary. After explosion of the mixture, the pressure within the cylinder will be dramatically increased thus opening the outlet valve and easily pushing open the start holding device, the long arm 18 is locked by the electromagnetic actuator 19, and the power piston 7 is moved to begin the power stroke of the normal working cycle.

After the starting procedures, the power stroke begins and the hydraulic fluid is transmitted to the rear portion of the hydraulic cylinder 26 through the outlet valve. The accumulator 23 is used for absorbing vibration. The hydraulic fluid (i.e. power) is output through an output pressure control valve 21 which can maintain the pressure within the hydraulic cylinder 26 when the output pressure is at low level, thereby maintaining the engine load at a constant value.

When the power stroke begins, the central processing unit will begin to receive signal from igniting sensor 13. The signal indicates whether the piston 7 has been moved or not. If no signal is received, this means that the starting is failed. On the contrary, it may receive the signal instead from the fuel injection sensor 15. When a signal is received, a counting program will be launched until the signal disappears. This is the instantaneous velocity value of the piston 7, which represents the time required for exhaust and intake strokes. If the velocity of the piston is higher, the kinetic energy will be higher. If the distance of the stroke is longer, the time required will be longer too, and vice versa. The fuel injection begins only when the piston is moved to close the exhaust port. The time is subtracted from the dead time of the fuel injection valve. Then, the fuel injection valve 3 is actuated to inject fuel. The opening time is proportional to the amount of injection fuel.

During the period, with the movement of the piston 7, the exhaust port 9 and the scavenging port 8 are opened in sequence, the scavenging air behind the piston 7 enters into the cylinder 6, the piston 7 stops and is pushed by the main spring 11 to proceed with the subsequent compression stroke.

When the pressure in the scavenging chamber is lowered, fresh air will enter into the scavenging chamber through the inlet reed valve 12 and the hydraulic cylinder 26 will be supplemented with fluid through the inlet valve 25.

After the fuel injection in compression stroke, the central processing unit will again receive signal from the ignition sensor 13. When the signal is received, the spark plug will be actuated to ignite thereby completing a whole working cycle.

During the operation of the engine, the central processing unit will inspect the numerical value of the hydraulic pressure sensor 22 at constant time so as to make sure whether it is necessary to stop the operation. During the procedure, the fuel injection is stopped to enter a monitoring waiting condition to check the numerical value of the pressure sensor 22 for preparing starting again.

Figure 3:
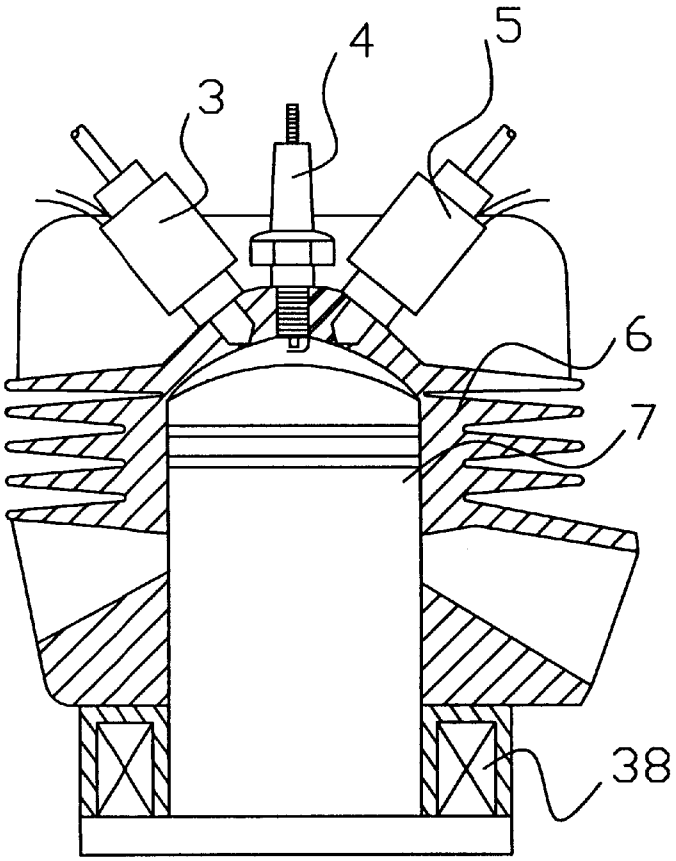
FIG. 3 is a sectional view illustrating a second starting method of holding a piston with a magnet.

Referring to FIG. 3, the piston 7 is located at the end of the compression stroke and the magnetic metal connected thereto can form a closed magnetic circuit with the magnet 38 fixedly mounted on the cylinder 6. The magnet has an attraction force equal to or slightly larger than the starting compression force applied to the piston, so that the piston 7 is held at a fixed position by the magnet when the engine is starting. In the meantime, fuel and compressed air are injected into a combustion chamber of the cylinder thereby forming well-mixed compressed mixture. Alternatively, compressed air-fuel mixture is directly injected into the combustion chamber to be ignited by a spark plug for producing explosion to overcome the holding force thus pushing the piston and beginning normal operating cycles.

Figure 4:
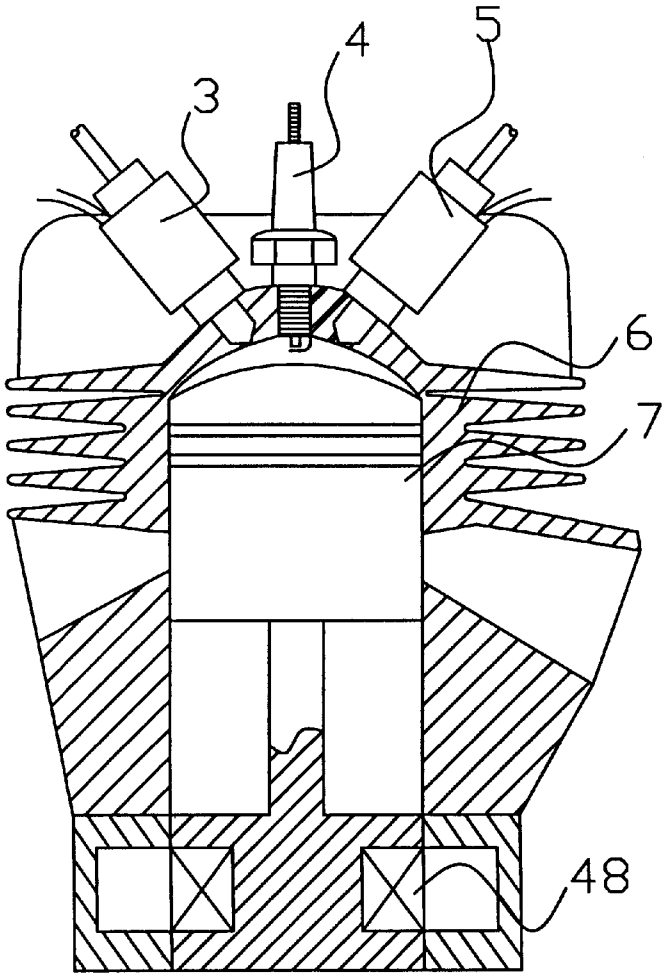
FIG. 4 is a sectional view illustrating a third starting method of holding a piston with a magnet.

As shown in FIG. 4, except the magnet 48 mounted on the piston 7 and the magnetic metal circuit is fixed on the cylinder, the starting way will be the same as that shown in FIG. 3.

I claim:

1. A free piston internal combustion engine, operating according to the principle of two-stroke cycle, utilizing hydraulic pressure to output power, comprising a cylinder assembly, a power piston, a main spring, a hydraulic cylinder assembly, and an electronic control unit, wherein:

said cylinder assembly includes a cylinder head and a cylinder in which said power piston is moved therein and having a rear end connected to the hydraulic cylinder assembly, said cylinder head being provided with a fuel injection valve, compressed air injection valve and a spark plug, fuel and compressed air being able to inject directly into a combustion chamber formed between said cylinder and said power piston, said cylinder having an intermediate portion formed with scavenging ports and an exhaust port, rear portion of said power piston and the rear portion of said cylinder forming a scavenging chamber, air being able to enter through an inlet reed valve and transfer to said scavenging ports for scavenging;

said power piston having an interior connected with said main spring and a ball-end pushrod, said main spring being used for absorbing kinetic energy in power stroke for pushing back said power piston in compression stroke, said ball-end pushrod being connected to a hydraulic piston, said power piston being provided at a rear end thereof with an interrupter for sensing an ignition sensor and fuel injection sensor;

said hydraulic cylinder assembly includes a hydraulic piston, a hydraulic cylinder, an inlet valve, a start holding device, an outlet valve, and a hydraulic pressure sensor, said start holding device being composed of a short arm, a shaft, a long arm, a magnet, and an electromagnetic actuator, said electromagnet actuator will release said long arm in starting to let said long arm to a position attracted by said magnet thereby applying force to said outlet valve through said shaft and said short arm and therefore locking the hydraulic fluid inside said hydraulic cylinder and counter-balancing compression force subjected by said hydraulic piston in starting, and after explosion, hydraulic pressure will overcome attraction force of said magnet, said outlet valve will push away said short and long arms to have said long arm locked by said electromagnetic actuator and said power piston will begin normal operating cycles;

said electronic control unit includes a single chip microprocessor and interface circuits for receiving signals from said hydraulic pressure sensor, ignition sensor, and fuel injection sensor for launching a program to control said fuel injection valve, said compressed air injection valve, said spark plug and said electromagnetic actuator.

2. A method of starting free piston internal combustion engines, comprising a hydraulic piston and hydraulic cylinder connected to a power piston, said hydraulic cylinder having an inlet valve, a holding device and an outlet valve, said holding device including a magnet and the mechanical arms which will be attracted by said magnet in starting, said mechanical arms applying force to said outlet valve to seal hydraulic fluid in said hydraulic cylinder in order to counterbalance compression force subjected by said piston in starting thereby keeping said power piston at a fixed position, said outlet valve pushing away said mechanical arms in reverse direction after initial explosion to release said mechanical arm from said magnet, said power piston being located at an end of the compression stroke and held by a hydraulic system when said internal combustion engine is starting, fuel and compressed air being injected into a combustion chamber of said cylinder at that time thus forming well-mixed compressed mixture, or compressed air-fuel mixture being directly injected into said combustion chamber to be ignited by said spark plug thereby causing explosion to overcome the holding force and pushing said piston to start normal operating cycles.

* * * * *

UNITED STATES PATENT AND TRADEMARK OFFICE

CERTIFICATE OF CORRECTION

PATENT NO. : 5,975,034

DATED : 2 NOVEMBER 1999

INVENTOR(S) : WILLIAM HAN

It is certified that error appears in the above-identified patent and that said Letters Patent is hereby corrected as shown below:

Title page, item [63] and Column 1, lines 3-6, delete in the entirety

Signed and Sealed this

Twenty-third Day of May, 2000

*Attest:*

Q. TODD DICKINSON

*Attesting Officer*

*Director of Patents and Trademarks*